US006149740A

United States Patent [19]

Bald et al.

[11] Patent Number: 6,149,740

[45] **Date of Patent: *Nov. 21, 2000**

[54] METHOD OF AND APPARATUS FOR MANUFACTURING HOT ROLLED STEEL STRIPS, IN PARTICULAR FROM STRIP-SHAPED CONTINUOUSLY CAST PRIMARY MATERIAL

[75] Inventors: Wilfried Bald, Hilchenbach; Dieter Rosenthal, Niederfischbach, both of Germany

[73] Assignee: SMS Schloemann-Siemag Aktiengesellschaft, Düsseldorf, Germany

[ * ] Notice: This patent is subject to a terminal disclaimer.

[21] Appl. No.: 09/059,327

[22] Filed: Apr. 13, 1998

Related U.S. Application Data

[63] Continuation-in-part of application No. 08/144,938, Oct. 28, 1993, abandoned.

[30] Foreign Application Priority Data

Oct. 28, 1992 [DE] Germany ..... 42 36 307

[51] Int. Cl.[7] ..... C21D 5/00

[52] U.S. Cl. ..... 148/544; 148/547; 148/567; 72/365.2

[58] Field of Search ..... 72/200, 202, 206, 72/234, 365.2, 366.2; 29/527.7; 164/476; 148/567, 544, 547, 541

[56] References Cited

U.S. PATENT DOCUMENTS 5,117,545 6/1992 Di Giusto ..... 148/541

FOREIGN PATENT DOCUMENTS 650328 9/1992 Australia .

*Primary Examiner*—Scott Kastler
*Attorney, Agent, or Firm*—Brown & Wood, LLP

[57] ABSTRACT

A method of and apparatus for manufacturing hot-rolled steel strips from a continuously cast primary material, preferably thin slabs, in a plurality of successive steps in a continuous operation is disclosed. In the invention, thin slabs, which leave an equalizing furnace, are heated above the maximum temperature that can be achieved in the equalizing furnace and are thereafter are broken down in a break-down train, with the broken-down thin slabs being subsequently recrystallized and cooled down to a rolling temperature before being finish-rolled in the finishing train.

10 Claims, 3 Drawing Sheets

METHOD OF AND APPARATUS FOR MANUFACTURING HOT ROLLED STEEL STRIPS, IN PARTICULAR FROM STRIP-SHAPED CONTINUOUSLY CAST PRIMARY MATERIAL

RELATED APPLICATION

This application is a continuation-in-part of application Ser. No. 08/144,938 filed Oct. 28, 1993, now abandonded.

FIELD OF THE INVENTION

The invention relates to a method of and an apparatus for manufacturing hot-rolled steel strips from a continuously cast primary material, preferably, from thin slabs, in a plurality of successive steps in a continuous operation.

BACKGROUND OF THE INVENTION

German Laid-open application (DE 4009860) discloses a method and an apparatus for manufacturing steel strips. However, the high-quality steels which require use of temperature controlled rolls, can not be produced by the disclosed method without certain limitations. In particular, this method of manufacturing of the high-quality steels is not sufficiently flexible with regard to the final thickness and to the final rolling temperature for manufacturing high-quality steels, which require a temperature above the maximum temperature achievable in the equalizing furnace, before the first step (breaking-down), and a noticeably lower temperature before the second step (finish-rolling).

Accordingly, the object of the invention is to provide a method and a apparatus for manufacturing hot rolled steel strips from a continuously cast primary material, which would be flexible enough for manufacturing substantially all known high-quality steels.

SUMMARY OF THE INVENTION

This and other objects of the invention, which shall be hereafter apparent, are achieved by heating the thin slabs leaving the equalizing furnace across their entire cross-section to a temperature above 1150° C., before they enter the break-down train, recrystalization of the broken-down thin slabs, and cooling of the recrystallized thin slabs to a rolling temperature before they enter the finishing train. With this method, it is possible to roll, in addition to the high-quality steels which could be produced up to the present, high-quality steels which require, before breaking-down, temperatures that exceed the maximum temperatures of the equalizing furnace selected, e.g., to correspond to the temperature stability of rolls, their bearing and drives.

The recrystalization permits the attainment of an optimal grain structure so that an unhardened unstressed material is rolled in the finishing train. This is achieved by matching the dwell time of the rolled stock in the recrystalization zone to specific properties of the rolled material.

Cooling the rolled stock before finish-rolling insures that the temperature for finish-rolling in the finishing train can be optimally determined in accordance with the rolling parameters, which correspond to the required temperature conditions in the finishing train, for all high-quality steel.

Coiling up of the thin slabs before recrystalization and uncoiling them after the recrystalization increase the dwell time of the rolled stock in the recrystalization zone, without a need for a large space for the recrystalization zone, and the use of a holding furnace permits reduction of the upkeep time before the finishing train, without the need to stop the preceding slabs.

The apparatus according to the invention includes a heater, which is arranged between the equalizing furnace and the first stand of the breaking-down train, recrystalization means between the breaking-down train and the finishing train, and a cooling apparatus between the recrystalization means and the finishing train. Use of an induction heater permits reduction of the time of heating the rolling stock, so that the difference in the grade of the rolling stocks does not present any problems.

If a high-output continuous installation is used, then two continuous casting machines, arranged parallel with each other, are associated with a single finishing train. When two casting lines are used, a ferry is provided between the two equalizing furnaces of the two casting lines and the heater. The ferry alternately transports the rolling stock from the two equalizing furnaces to the heater. If the finishing train is aligned with one of the casting lines then, advantageously, an accumulator furnace is arranged downstream of the ferry.

BRIEF DESCRIPTION OF THE DRAWINGS

The invention will now be described in detail with reference to the drawings, wherein.

DETAILED DESCRIPTION OF THE PREFERRED EMBODIMENTS

Figure 1:
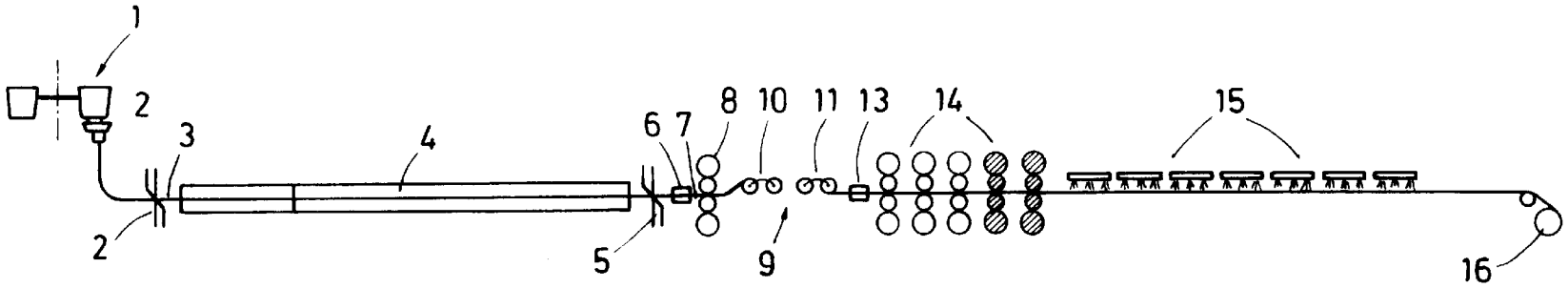
FIG. 1 is schematic side view of a single line continuous apparatus according to the present invention.

Referring now to the drawings, wherein like numerals designates like elements, throughout the several views, FIG. 1 shows a continuous casting machine 1 and a shear 2, arranged downstream of the casting machine for cutting a continuously cast primary material into separate thin slabs 3 having a length corresponding to the desired coil weight. Downstream of the shear 2, there is provided an equalizing furnace 4, which is followed by another shear 5. An induction heater 6, located downstream of the equalizing furnace 4, can heat thin slabs 3 leaving the equalizing furnace 4 to a temperature above 1150° C. and across their entire cross-section. A de-scaling washing device 7 and a break-down train, here a preliminary roll stand 8, follow the induction heater 6. A recrystalization zone 9 follows the preliminary roll stand 9. A coiler 10 and an uncoiler 11, e.g., a coilbox, are provided in the recrystalization zone 10. A holding furnace 12 is provided at the coiler 10 and uncoiler 11, in which the reeled coils can be stored for interim accumulation and for recrystalization. In the feed direction, a cooling device 13 is arranged downstream of the uncoiler 11, in which the rolled strip is cooled to an optimal temperature for the following finishing train 14 and if necessary, can be de-scaled. Another cooling zone 15 follows the finishing train 14, with an upcoiler 16 following the cooling zone 15.

Figure 2:
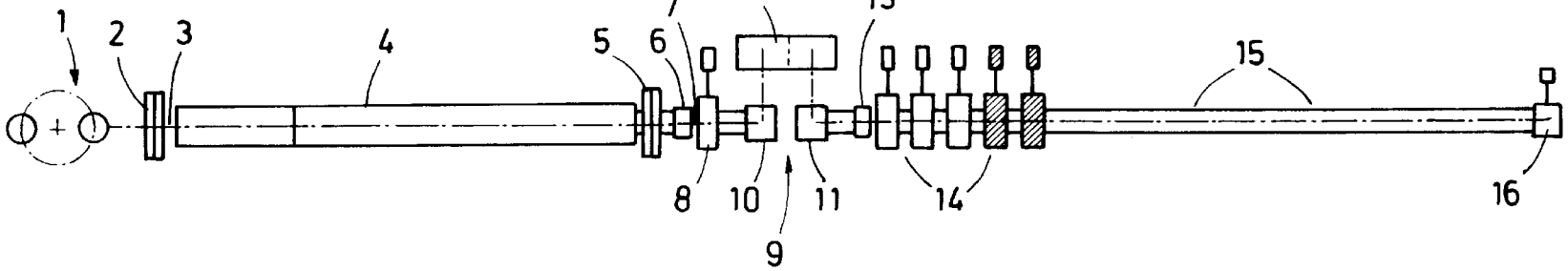
FIG. 2 is a plan view of the apparatus shown in FIG. 1.

FIG. 2 depicts two continuous casting machines 1,1' arranged parallel to each other, two shears 2,2' and two equalizing furnaces 4,4'. A ferry 17 follows the furnaces 4,4'. The ferry 17 comprises a single car 18. The car 18 alternatively transports the thin slabs 3,3' from respective equalizing furnaces 4,4' to the pitch line.

Figure 3:
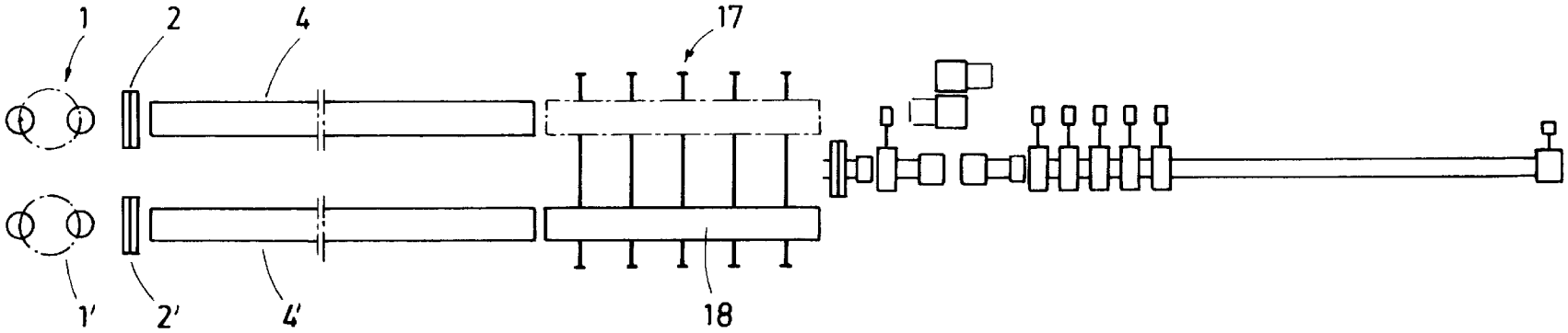
FIG. 3 is a schematic plan view of a two-line continuous apparatus according to the invention.
Figure 4:
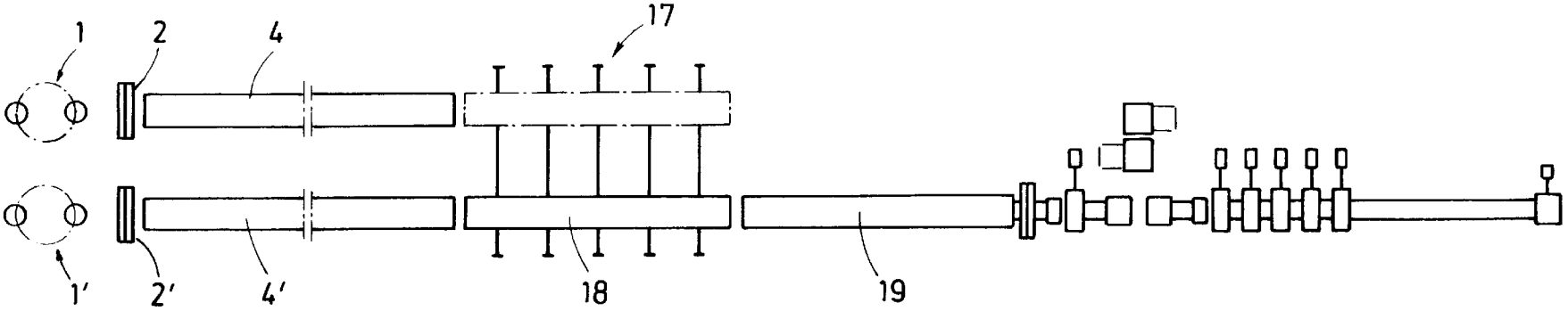
FIG. 4 is a schematic plan view of a modified two-line continuous apparatus according to the invention.

FIG. 3 depicts an embodiment, in which the continuous casting machine 1', the shear 2' and the equalizing furnace 4' are arranged along the same line as the rolling train, whereas the continuous casting machine 1, the shear 2 and the equalizing furnace 4 are arranged along a line which extends parallel to the pitch line. In this embodiment, the ferry 17 serves likewise for alternatively transporting the rolled material into the pitch line. To insure a uniform casting and rolling process, an accumulator 19 is arranged downstream of the ferry. The accumulator is arranged in the same line as the finishing train and may be heated or not.

While the preferred embodiments of the intention have been depicted in detail, it is to be express understood that modifications and adaptations may be made thereto, without departing from the spirit and scope of the invention, as delineated in the following claims:

What is claimed is:

1. A method of manufacturing hot-rolled steel strips from a continuously cast primary material in a plurality of successive continuous steps, said method comprising the steps of:

cutting off a thin slab of a pre-determined length corresponding to a desired coil weight from a solidified primary material;

homogenizing the thin slab in a equalizing furnace;

thereafter, heating the thin slab across an entire cross-section thereof to a temperature above 1150° C. in a heater located downstream of the equalizing furnace;

thereafter, breaking down the thin slab in a break-down train;

recrystallizing the thin slab;

thereafter, cooling the broken down thin slab to a rolling temperature;

thereafter, finish-rolling the thin slab for producing a finish-rolled strip;

cooling down the finish-rolled strip; and reeling the finish-rolled strip in an upcoiler.

2. An apparatus for manufacturing hot rolled steel strips from a continuously cast primary material, said apparatus comprising:

at least one continuously casting machine for continuously casting the primary material;

at least one shear arranged down stream of the at least one continuously casting machine for cutting off a separate thin slab from the primary material;

an equalizing furnace located downstream of the shear for homogenizing the thin slab;

a heater located downstream of the equalizing furnace and capable of heating the thin slab leaving the equalizing furnace to a temperature a 1150° C. across an entire cross-section of the slab;

a break-down train located downstream of the heater for breaking down the thin slab leaving the heater;

recrystallization means located downstream of the break-down train for recrystallization of the thin slab having the break-down train; and means located, downstream of the recrystallization means, for cooling down the thin slab leaving the recrystallization means to a rolling temperature;

a finishing train for finish-rolling the thin slab to produce finish-rolled strip;

means located downstream of the finishing train for cooling down the finish-rolled strip; and an upcoiler located downstream of the means for cooling down the finish-rolled strip for reeling the finish-rolled strip.

3. A method as set forth in claim 1, further comprising the steps of:

coiling up the thin slab after the breaking down and before recrystalization; and uncoiling the thin slab after the recrystalization and before cooling down to a rolling temperature.

4. A method as set forth in claim 3, further comprising the step of interim storing the coiled up thin slab before recrystalization.

5. An apparatus as set forth in claim 2, wherein the heater comprises an induction means.

6. An apparatus as set forth in claim 2, wherein a coiler and an uncoiler are arranged at the recrystalization means.

7. An apparatus as set forth in claim 6, wherein the uncoiler comprises a coilbox.

8. An apparatus as set forth in claim 2, further comprising a holding furnace associated with the recrystalization means.

9. An apparatus as set forth in claim 2, comprising:

two casting machines, extending parallel to each other;

two shears arranged downstream of the two casting machines, respectively;

two equalizing furnaces arranged downstream of the two shears, respectively; and a ferry, arranged between the two equalizing furnaces and the heater, for alternatively transporting thin slabs from the two equalizing furnaces to the heater.

10. An apparatus as set forth in claim 9, further comprising an accumulator arranged downstream of the ferry and upstream of the heater.

* * * * *